US005358039A

United States Patent [19]

Fordham

[11] Patent Number: 5,358,039

[45] Date of Patent: Oct. 25, 1994

[54] CENTRALIZER FOR A BOREHOLE

[75] Inventor: Hugh E. Fordham, Sarawak, Malaysia

[73] Assignee: Schlumberger Technology Corporation, Houston, Tex.

[21] Appl. No.: 148,140

[22] Filed: Nov. 4, 1993

[30] Foreign Application Priority Data

Nov. 5, 1992 [FR] France ..... 92 13304

[51] Int. Cl.[5] ..... E21B 17/00

[52] U.S. Cl. ..... 166/241.1; 166/172

[58] Field of Search ..... 166/241.1, 170, 172–176

[56] References Cited

U.S. PATENT DOCUMENTS 3,108,639 10/1963 Brooks ..... 166/172
3,555,689 1/1971 Cubberly .
3,915,229 10/1975 Nicolas .
4,595,055 6/1986 Vannier .
4,830,105 5/1989 Petermann .

*Primary Examiner*—Michael Powell Buiz
*Attorney, Agent, or Firm*—Henry N. Garrana; John H. Bouchard

[57] ABSTRACT

The centralizer comprises a main assembly suitable for centering a well tool in casing, and a removable adapter assembly (75) for use in the open hole portion of a borehole. The main assembly comprises a body (30), longitudinally spaced-apart supports (36, 41) slidably mounted on the body, and pairs of hinged arms ($45_1$, $47_1$) disposed between the slidable supports. The central hinges ($50_1$) of the pairs of arms carry wheels ($51_1$) and are spaced apart laterally from the body under the effect of blade springs ($52_1$, $53_1$). The adapter assembly (75) comprises curved spring blades ($80_1$) hinged on link collars (77, 82) removably fixed on the sliding supports. The wheels are laterally spaced apart from the spring blades. The centralizer is easily modified to operate either in the case hole portion or in the open hole portion of a borehole.

24 Claims, 2 Drawing Sheets

CENTRALIZER FOR A BOREHOLE

FIELD OF THE INVENTION

The invention relates to well tools used in boreholes, and more particularly to a centralizer for maintaining well tools suspended at the end of a cable on the axis of a borehole.

BACKGROUND OF THE INVENTION

Numerous types of centralizer for use in boreholes are known. Known centralizers are preferably made differently depending on whether they are intended for use in an open hole portion or in a cased hole portion of a borehole. A borehole comprises an "open hole" portion whose diameter varies, often considerably, and whose wall is formed by geological formations that may be soft to a greater or lesser extent, and a "cased hole" portion that is lined with metal casing and whose diameter varies little, A centralizer optimized for the cased hole portion is generally unsuitable for the open hole portion of a borehole. Conversely, a centralizer sliding against the formations is not optimized for the hard wall provided by casing.

It is thus usual to design different centralizers for different applications.

Certain centralizers are particularly adapted to centering a well tool in the casing of a borehole. An example of such a centralizer is described in U.S. Pat. No. 4,595,055 (Vannier). That device comprises wheels that bear against the wall of the casing, which wheels are mounted at the ends of hinged arms that are urged outwardly by a combination of curved resilient spring blades and coil springs. Such a centralizer operates satisfactorily in casing where the wall is made of metal and is hard. It is not adapted for sliding properly against a wall made up of geological formations, as would apply if it were to be used in an open hole portion.

Centralizers are also known that are adapted to operate in the open hole portion of a borehole. Such centralizers use curved resilient spring blades whose central portions bear slidably against the formations. In some centralizers, coil springs are provided that cooperate with the spring blades to provide a centering force that is substantially constant over a wide range of borehole diameters. The force of the coil springs is transmitted to the central portions of the spring blades by means of hinged arms.

A centralizer adapted to center a well tool in an open hole portion of a borehole is described in U.S. Pat. No. 3,915,229 (Nicolas). That device comprises a body and curved spring blades whose central portions bear against the wall of the borehole. The central portions of the blades are maintained at a uniform distance from the body by means of arms hinged on a collar that is slidably mounted on the body and that is subjected to thrust from a coil spring.

Another centralizer designed for centering a tool in the open hole portion of a borehole is described in U.S. Pat. No. 3,555,689 (Cubberly). That centralizer comprises a body on which two collars slide that are urged towards each other by a coil spring. Curved spring blades mounted between the two collars have central portions that bear against the wall of the borehole. The action of the spring blades and that of the coil springs combine to urge the blades against the wall of the borehole with a force that is substantially constant. Hinged arms mounted between the collars come into contact with the central portions of the blades to maintain them at a uniform lateral distance from the support.

OBJECTS OF THE INVENTION

An object of the invention is to provide a centralizer suitable for use in the open hole portion or in the cased portion of a borehole.

Another object of the invention is to provide a dual-purpose centralizer of relatively low cost.

Another object of the invention is to provide a centralizer including a removable assembly enabling it to be optimized as a function of the environment in which it is to be used.

SUMMARY OF THE INVENTION

In one aspect, the present invention provides a centralizer for a borehole, the centralizer comprising a main assembly suitable for centering a well tool in casing, the main assembly including: an elongate body; first and second longitudinally spaced-apart supports slidably mounted on the body; hinged arm structures disposed around the body, each structure including a first arm hinged on the first support, a second arm hinged on the second support, and a central hinge disposed between the first and second arms so as to move laterally away from the body when the first and second supports are moved towards each other; and spring means for moving the central hinges laterally away from the body. The centralizer further comprises an adapter assembly comprising curved spring blades removably hinged on the first and second supports, the lengths of the spring blades being selected so that their central portions are further from the body than the central hinges after the spring blades have been fixed on the main assembly. The adapter assembly thus cooperates with the main assembly to form a centralizer which is suitable for centering the well tool in the open hole portion of the borehole.

Preferably, the adapter assembly comprises first and second link collars removably fixed to the first and second supports, the ends of the spring blades being hinged on said link collars. The central hinges carry wheels and the spring blades are designed so that their central portions are laterally spaced apart from the wheels.

BRIEF DESCRIPTION OF THE DRAWINGS

The characteristics and advantages of the invention appear more clearly from the following description of an embodiment of the invention given by way of non-limiting example and with reference to the accompanying drawings, in which.

DETAILED DESCRIPTION OF THE INVENTION

Figure 1:
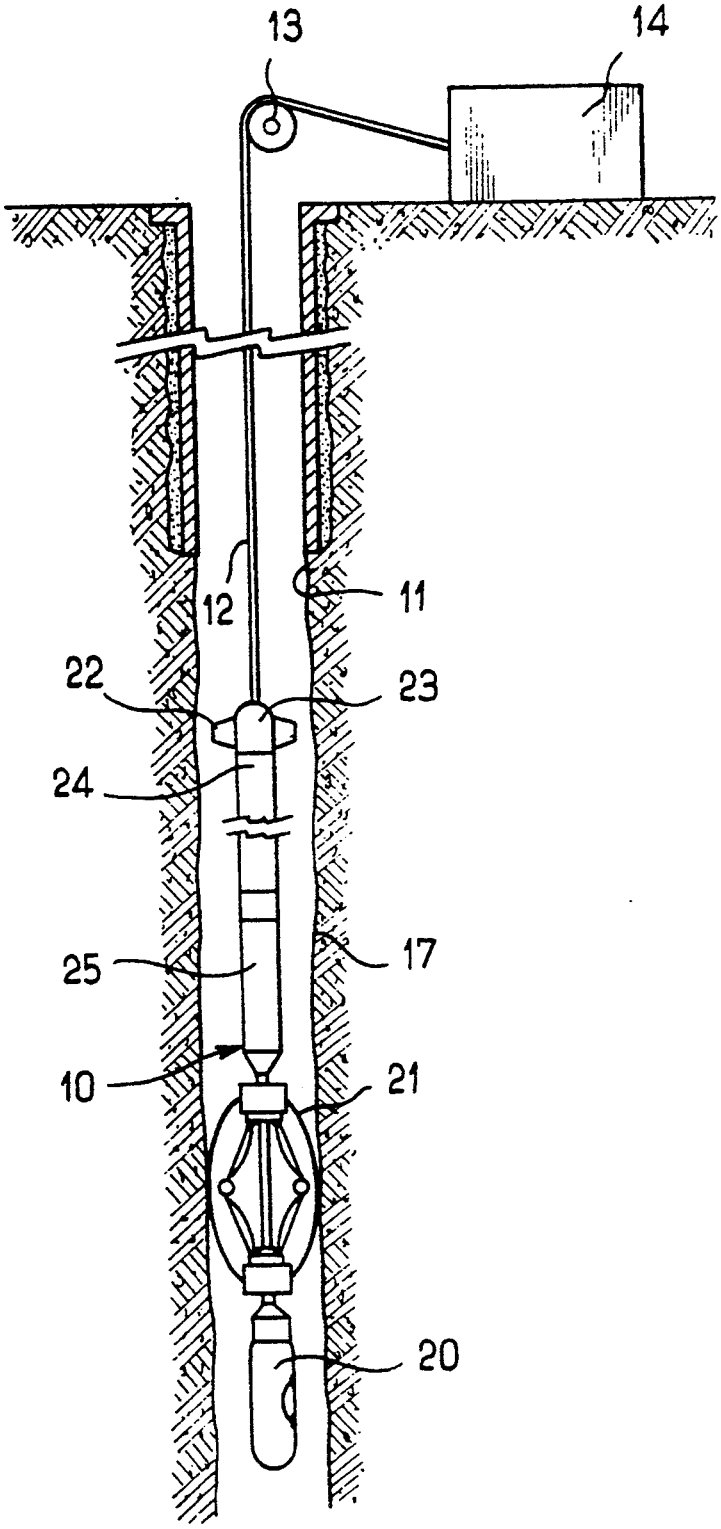
FIG. 1 shows a logging tool suspended down a borehole and fitted with a centralizer of the invention.

With reference to FIG. 1, a well tool which is constituted in the present example by an acoustic logging tool 10 is shown in a borehole 11, suspended at the end of a cable 12 which passes over a sheave 13 and is wound onto a winch (not shown) forming a portion of surface equipment 14. The winch of the surface equipment 14 enables the logging tool 10 to be moved up and down along the borehole. The borehole 17 includes a top portion lined with casing 16, also referred to as the cased hole portion. Beneath the casing 16, the borehole 11 has an open hole portion 17 in which the wall of the borehole is formed by geological formations without support.

The logging tool 10 shown by way of example comprise a rotary ultrasound sensor 20 at its bottom end for scanning the wall of the borehole as it rotates. Such a sensor is known to the person skilled in the art and it emits ultrasound pulses towards the wail and then detects the echoes reflected by the formations so as to obtain an acoustic image of the wall. The axis of the sensor is maintained substantially on the axis of the borehole by a centralizer 21 and by a spacer ring 22 which prevents the top of the tool coming too close to the wall of the borehole, even in a borehole that is deflected.

The logging tool 10 connected to the cable 12 via a connection head 23 that carries the spacer ring 22 conventionally comprises a sealed cartridge 24 at its top end containing electronic circuits for receiving and transmitting control signals from the surface equipment 14 in order to control the operation of the tool 10. The electronic circuits also serve for emitting, for receiving, for processing and for transmitting to the surface measurement signals from the sensor 20. The centralizer 21 is extended upwards by a case 25 containing a motor for rotating the sensor 20.

Proper operation of such a logging tool 10 depends on the quality of the centering provided by the centralizer 21. The centralizer must maintain the sensor 20 accurately at the center of the borehole even if the borehole is greatly inclined. But above all, the friction resistance of the centralizer along the borehole must not be jerky, even in the event of the borehole dip meter changing suddenly, so that the speed of the tool can remain as uniform as possible while measurement is taking place.

The logging tool having a rotary ultrasound transducer as shown is used for obtaining an image of the wail of the borehole as constituted by the formations. There also exists a version of the logging tool having a rotary ultrasound transducer which is used for in situ evaluation of casing corrosion and of the quality of casing cementing, and which is therefore displaced along the cased hole portion of the borehole. Such an apparatus then uses two centralizers obtained by a simple modification to the centralizer 21 as explained below. The centralizer 21 can thus be used either in the cased hole portion or in the open hole portion of the borehole.

Figure 2:
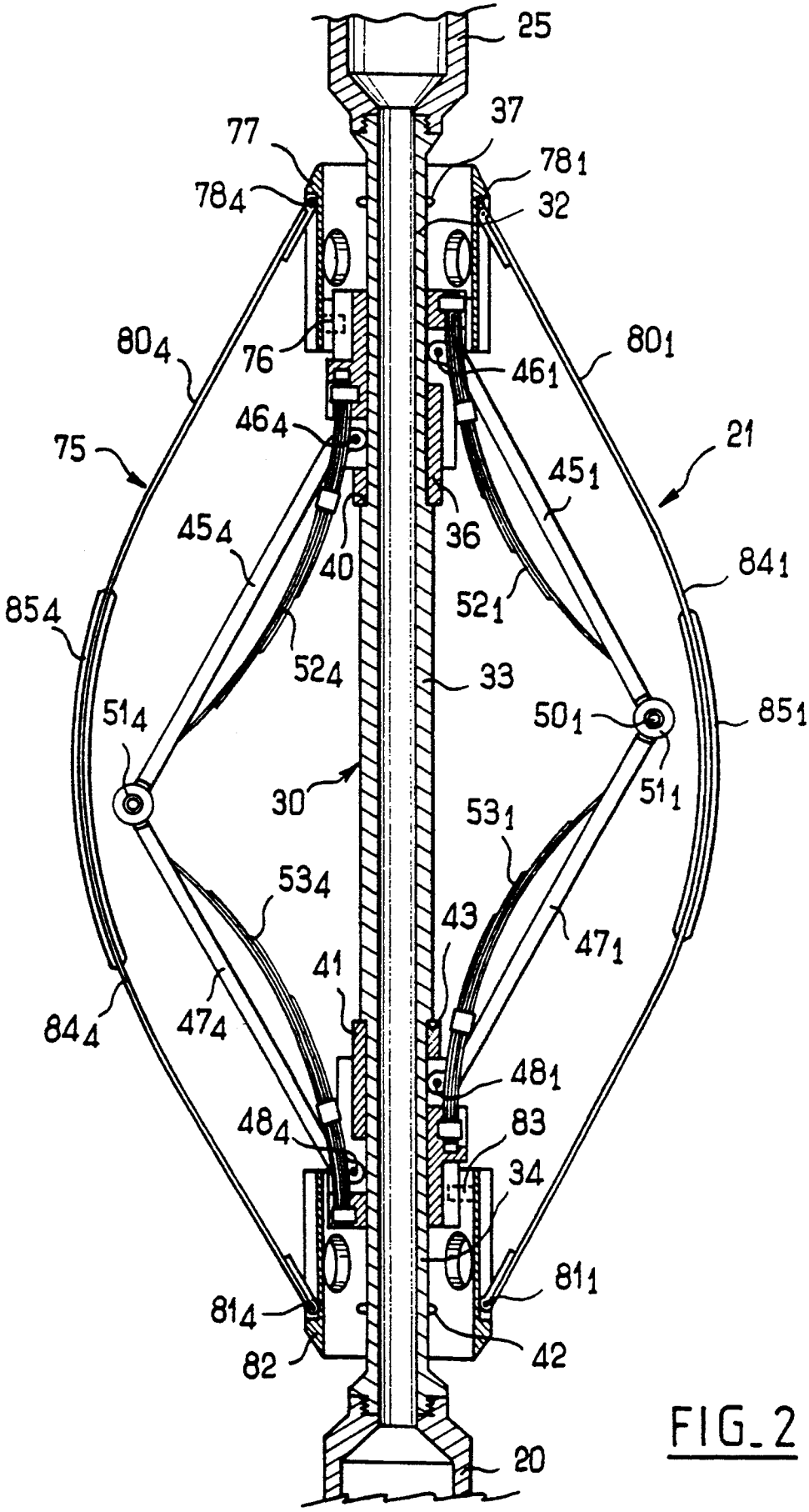
FIG. 2 is a detailed longitudinal section through the centralizer of the FIG. 1 tool.

With reference to FIG. 2, the centralizer 21 comprises a tubular body 30 having, from top to bottom: a top portion of small diameter 32, a central portion 33, and a bottom portion of small diameter 34. The top end of the body 30 is screwed to the case 25 and its bottom end is screwed to the sensor 20. A first annular support 36 is slidably mounted on the top portion 32 of the body to slide between a high position defined by an abutment 37 and a low position defined by a shoulder 40 that faces upwards and that is situated between the top small diameter portion 32 and the central portion 33 of the body.

Similarly, the bottom portion 34 of the body has a second annular support 41 slidably mounted thereon with its stroke being limited downwards by an abutment 42 and upwards by a shoulder 43 disposed between the small diameter bottom portion 34 and the central portion 33 of the body.

Six pairs of arms or arm structures are regularly distributed around the body 30, being hinged between the first and second sliding supports 36 and 41. Each pair of arms comprises a top arm $45_1$ hinged via a transverse pivot $46_1$ to the first support 36 and a bottom arm $47_1$ hinged via a transverse pivot $48_1$ to the second support 41, where it is an index lying in the range 1 to 6. In FIG. 2, only the first and fourth pairs of arms $45_1$, $47_1$ and $45_4$, $47_4$ are shown. It will be observed that the pairs of arms having odd-numbered indices such as $45_1$ and $47_1$ are slightly offset upwards relative to the pairs of arms having even-numbered indices such as $45_4$ and $47_4$. This disposition makes it possible for the centralizer to pass more progressively from a large diameter section of the borehole to a section of the borehole having a smaller diameter.

The arms $45_1$, $47_1$ in the same pair are hinged together by means of a central hinge $50_1$ having a wheel $51_1$ rotatably mounted thereon. Curved blade springs $52_1$ having their bases fixed to the support 36 boar against the arms $45_1$ in the vicinity of their central hinges $50_1$ so as to separate the wheels $51_1$ from the body and to move the sliding supports 36 and 41 towards each other. The curvature and the number of blade springs $52_1$ are selected so that the radically outward forces applied to the wheels are substantially constant regardless of the distance between the body 30 and the wheels.

The body 30, the supports 36 and 41, the hinged arms $45_1$ and $47_1$, the wheels $51_1$, and the blade springs $52_1$ and $53_1$ together constitute a main assembly suitable for centering the logging tool 10 in the cased hole portion of a borehole. This main assembly has all of the functions required for optimized centralizing within casing, in particular because of the wheels $51_1$ which are pressed against the steel wall with a radial force that is substantially constant.

However, the centralizer formed by this main assembly is not suitable for centering in the open hole portion of a borehole since the wall thereof may be covered with a cake of mud or the formations themselves may be relatively soft, such that the wheels are in danger of penetrating into the wall of the borehole, thereby preventing them from operating and possibly also causing them to hinder centralizer operation. In addition, the open hole portion of a borehole includes frequent changes in diameter. For a centralizer constituted by the above-described main assembly, a sudden reduction of diameter can cause a longitudinal force to be applied to the arms that gives rise to a sudden increase in the resistance of the tool to longitudinal displacement. Angular hinged arm structures that could be caused to bear against the wall are therefore unsatisfactory in a centralizer that is intended for use in the open hole portion of a borehole.

As described below, the centralizer 21 includes a removable adapter assembly 75 which enables the centralizer to be used optimally in the open hole portion 17 of the borehole.

A link collar 77 is fixed by screws 76 onto the top annular support 36. The collar has pivots $78_1$ hinged to the top ends of six spring blades $80_1$ that are uniformly distributed around the body. The bottom ends of the spring blades $80_1$ are hinged on pivots $81_1$ disposed on a bottom link collar 82 which is fixed to the bottom annular support 41 by screws 83. The lengths of the spring blades $80_1$ are selected so that the central portions $84_1$ thereof do not bear against the wheels $51_1$ except when the centralizer is in its completely closed position, in which case the spring blades come into contact with the wheels $51_1$ which in turn bear against the central portion 33 of the body 30.

The central portions of the spring blades $80_1$ are surrounded by a flexible elastomer coating $85_1$. It has been found that the spacing between the wheels $51_1$ and the central portions of the spring blades $81_1$ improves the behavior of the centralizer when it needs to pass from a large diameter zone of the borehole to a smaller diameter zone thereof. Since the spring blades $80_1$ are distant from the wheels $51_1$, they can deform slightly in an inwards direction, thereby better absorbing variations in borehole diameter without jerking the cable. A narrowing of diameter gives rise to a longitudinal force that moves the sliding supports apart from each other and that opposes the force of the blade springs $52_1$ and $53_1$. The vertical motion of the well tool is thus more uniform than that obtained with conventional centralizers.

As shown above, the case 25 contains a motor (not shown) for rotating the rotary sensor 20. Although not shown in the figure, the body 30 of the centralizer has a mechanical transmission passing longitudinally therethrough connecting the electrical motor to the rotating sensor. In addition, the body 30 has conductors passing through it to provide an electrical connection with the sensor. The body 30 could also be fitted with top and bottom connection heads enabling a releasable mechanical and electrical connection to be established between the sections of the tool disposed above and below the centralizer.

The centralizer 21 is very easily fitted to a logging tool for performing measurements in the cased hole portion of a borehole. It suffices to remove the adapter assembly 75 constituted by the link collars 77 and 82 and the blade springs $80_1$ to obtain a centralizer which, with its spring blades $52_1$ and $53_1$ and its wheels $51_1$ is optimized for the case hole portion of the borehole. The link collars 77 and 82 are adapted to pass around the main assembly when the main assembly is in its closed position, thereby enabling the adapter assembly to be installed on said main assembly by being threaded over one of the ends of the body. Once it is in place, the adapter assembly is secured to the main assembly by the screws 76 and 83.

The centralizer described above can be varied in numerous ways without thereby going beyond the ambit of the invention as defined in the accompanying claims. In particular, the spring blades can be removably hinged on the sliding supports by means other than the collars 77 and 82. The pairs of arms may be designed so that the wheels are all at the same level. The wheels may be removably mounted on the central hinges of the arms and they may be installed only when the centralizer is to be used in the case hole portion of the borehole.

I claim:

1. A centralizer for a borehole, the centralizer comprising a main assembly suitable for centering a well tool in casing, said main assembly including: an elongate body; first and second longitudinally spaced-apart supports slidably mounted on the body; hinged arm structures disposed around the body, each structure including a first arm hinged on the first support, a second arm hinged on the second support, and a central hinge disposed between the first and second arms so as to move laterally away from the body when the first and second supports are moved towards each other; and spring means for moving the central hinges laterally away from the body; said centralizer further including an adapter assembly comprising curved spring blades removably hinged on the first and second supports, the lengths of the spring blades being selected so that their central portions are further from the body than the central hinges after the spring blades have been secured to the main assembly, the adapter assembly thus cooperating with the main assembly to form a centralizer which is suitable for centering the well tool in the open hole portion of the borehole.

2. A centralizer according to claim 1, wherein the adapter assembly comprises first and second link members removably fixed on the first and second supports, the spring blades having their ends hinged on the first and second link members.

3. A centralizer according to claim 2, wherein the first and second link members are collars surrounding the first and second supports, at least one of the collars being adapted to pass around the main assembly when in its closed position so as to enable it to be threaded over said main assembly.

4. A centralizer according to claim 1, wherein the spring means include blade springs mounted between the supports and the hinged arm structures so as to apply a substantially constant radial force on the central hinges.

5. A centralizer according to claim 2, wherein the spring means include blade springs mounted between the supports and the hinged arm structures so as to apply a substantially constant radial force on the central hinges.

6. A centralizer according to claim 3, wherein the spring means include blade springs mounted between the supports and the hinged arm structures so as to apply a substantially constant radial force on the central hinges.

7. A centralizer according to claim 1, wherein it comprises the same number of spring blades as it comprises hinged arm structures, each of the arm structures being disposed between the body and one of the spring blades.

8. A centralizer according to claim 2, wherein it comprises the same number of spring blades as it comprises hinged arm structures, each of the arm structures being disposed between the body and one of the spring blades.

9. A centralizer according to claim 3, wherein it comprises the same number of spring blades as it comprises hinged arm structures, each of the arm structures being disposed between the body and one of the spring blades.

10. A centralizer according to claim 4, wherein it comprises the same number of spring blades as it comprises hinged arm structures, each of the arm structures being disposed between the body and one of the spring blades.

11. A centralizer according to claim 5, wherein it comprises the same number of spring blades as it comprises hinged arm structures, each of the arm structures being disposed between the body and one of the spring blades.

12. A centralizer according to claim 6, wherein it comprises the same number of spring blades as it comprises hinged arm structures, each of the arm structures being disposed between the body and one of the spring blades.

13. A centralizer according to claim 1, wherein the central hinges are fitted with wheels.

14. A centralizer according to claim 2, wherein the central hinges are fitted with wheels.

15. A centralizer according to claim 3, wherein the central hinges are fitted with wheels.

16. A centralizer according to claim 4, wherein the central hinges are fitted with wheels.

17. A centralizer according to claim 13, wherein the spring blades are designed so that their central portions are laterally spaced apart from the wheels.

18. A centralizer according to claim 14, wherein the spring blades are designed so that their central portions are laterally spaced apart from the wheels.

19. A centralizer according to claim 15, wherein the spring blades are designed so that their central portions are laterally spaced apart from the wheels.

20. A centralizer according to claim 16, wherein the spring blades are designed so that their central portions are laterally spaced apart from the wheels.

21. A centralizer according to claim 1, wherein the central portions of the spring blades are provided with a flexible coating.

22. A centralizer according to claim 2, wherein the central portions of the spring blades are provided with a flexible coating.

23. A centralizer according to claim 3, wherein the central portions of the spring blades are provided with a flexible coating.

24. A centralizer according to claim 4, wherein the central portions of the spring blades are provided with a flexible coating.

* * * * *